US011479893B2

(12) United States Patent
Yin et al.

(10) Patent No.: US 11,479,893 B2
(45) Date of Patent: Oct. 25, 2022

(54) METHOD AND APPARATUS FOR WASHING MACHINE DEHYDRATION, AND WASHING MACHINE

(71) Applicant: GREE ELECTRIC APPLIANCES, Guangdong (CN)

(72) Inventors: Dong Yin, Guangdong (CN); Mingxing Zheng, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 764 days.

(21) Appl. No.: 16/326,537

(22) PCT Filed: Sep. 11, 2017

(86) PCT No.: PCT/CN2017/101207
§ 371 (c)(1),
(2) Date: Feb. 19, 2019

(87) PCT Pub. No.: WO2018/064927
PCT Pub. Date: Apr. 12, 2018

(65) Prior Publication Data

US 2021/0292955 A1 Sep. 23, 2021

(30) Foreign Application Priority Data

Oct. 8, 2016 (CN) ..... 201610883646.8

(51) Int. Cl.
*D06F 33/48* (2020.01)
*D06F 33/40* (2020.01)
(Continued)

(52) U.S. Cl.
CPC ..... *D06F 33/48* (2020.02); *D06F 33/40* (2020.02); *D06F 33/76* (2020.02); *D06F 35/007* (2013.01);
(Continued)

(58) Field of Classification Search
CPC ..... D06F 33/40; D06F 33/48; D06F 35/007; D06F 33/76
See application file for complete search history.

(56) References Cited

U.S. PATENT DOCUMENTS 7,451,510 B2 11/2008 Lee
7,676,874 B2 * 3/2010 Cho ..... D06F 34/30 68/23.1
(Continued)

FOREIGN PATENT DOCUMENTS

CN 1459529 A 12/2003
CN 1548611 A 11/2004
(Continued)

OTHER PUBLICATIONS

International Search Report for International Application No. PCT/CN2017/101207, dated Dec. 22, 2017, 2 pages.
(Continued)

*Primary Examiner* — Joseph L. Perrin
*Assistant Examiner* — Kevin G Lee
(74) *Attorney, Agent, or Firm* — Armstrong Teasdale LLP

(57) ABSTRACT

Disclosed are a method and apparatus for washing machine dehydration, and a washing machine. The method includes: step 1, detecting a current eccentricity value to serve as a first eccentricity value, and determining a first dehydration rotational speed value corresponding to the first eccentricity value; step 2, performing a corresponding dehydration operation; step 3, detecting another current eccentricity value to serve as a second eccentricity value, and determining a second dehydration rotational speed value corresponding to the second eccentricity value; step 4, if the second eccentricity value is smaller than the first eccentricity value, performing a corresponding dehydration operation, assigning the value of the second eccentricity value to the first eccentricity value and then performing the step 3; and step
(Continued)

5, if the second eccentricity value is greater than or equal to the first eccentricity value, performing a leveling operation, and then performing the step 3.

12 Claims, 3 Drawing Sheets

(51) Int. Cl.

| | |
|---|---|
| ***D06F 35/00*** | (2006.01) |
| ***D06F 33/76*** | (2020.01) |
| *D06F 103/26* | (2020.01) |
| *D06F 103/44* | (2020.01) |
| *D06F 105/48* | (2020.01) |
| *D06F 33/52* | (2020.01) |

(52) U.S. Cl.
CPC ..... *D06F 33/52* (2020.02); *D06F 2103/26* (2020.02); *D06F 2103/44* (2020.02); *D06F 2105/48* (2020.02)

(56) References Cited

U.S. PATENT DOCUMENTS

| | | | |
|---|---|---|---|
| 2005/0251926 | A1 | 11/2005 | Lee et al. |
| 2005/0283919 | A1 | 12/2005 | Kim |

FOREIGN PATENT DOCUMENTS

| | | | | |
|---|---|---|---|---|
| CN | 1676734 | A | | 10/2005 |
| CN | 101586300 | A | | 11/2009 |
| CN | 103233340 | A | | 8/2013 |
| CN | 104919106 | A | | 9/2015 |
| CN | 105970549 | A | | 9/2016 |
| CN | 106436155 | A | | 2/2017 |
| KR | 950007072 | B1 | * | 6/1995 |
| WO | 0028128 | A1 | | 5/2000 |

OTHER PUBLICATIONS

Supplementary European Search Report for corresponding European App. No. 17857808.4, dated Jun. 2, 2020, 6 pages.

* cited by examiner

METHOD AND APPARATUS FOR WASHING MACHINE DEHYDRATION, AND WASHING MACHINE

CROSS-REFERENCE TO RELATED APPLICATIONS

The present application is the national stage entry of International Patent Application No. PCT/CN2017/101207, filed on Sep. 11, 2017, which claims the benefit of priority to Chinese Patent Application No. 201610883646.8, filed on Oct. 8, 2016, the contents of which are hereby incorporated by reference in their entirety.

TECHNICAL FIELD

The embodiments of the disclosure relate to the technical field of dehydration, and in particular to a method and apparatus for washing machine dehydration, and a washing machine.

BACKGROUND

When an existing washing machine washes a small load of clothes having good water absorbability, a condition in which the water is not dehydrated or the water cannot be dehydrated completely is occurred. For example, one or two sweaters absorb a large amount of water after washing and a small amount of clothes cannot be uniformly distributed in a roller, so that an eccentricity value is very high and the washing machine cannot enter dehydration. Even though the washing machine enters the dehydration, due to the very high eccentricity value, a dehydration rotational speed is low and thus the clothes cannot be dehydrated completely.

Concerning the problem of a poor dehydration effect when the washing machine washes the small load of clothes having the good water absorbability in the conventional art, an effective scheme hasn't been proposed till now.

SUMMARY

In order to solve the above technical problem, the embodiments of disclosure provide a method for washing machine dehydration, which may include: step 1, a current eccentricity value is detected to serve as a first eccentricity value, and a first dehydration rotational speed value corresponding to the first eccentricity value is determined; step 2, according to a comparison result between the first dehydration rotational speed value and a preset rotational speed value, a corresponding dehydration operation is performed; step 3, a current eccentricity value is detected to serve as a second eccentricity value, and a second dehydration rotational speed value corresponding to the second eccentricity value is determined; step 4, if the second eccentricity value is smaller than the first eccentricity value, according to a comparison result between the second dehydration rotational speed value and the preset rotational speed value, a corresponding dehydration operation is performed, the value of the second eccentricity value is assigned to the first eccentricity value and then the step 3 is performed; and step 5, if the second eccentricity value is greater than or equal to the first eccentricity value, a leveling operation is performed, and then the step 3 is performed.

In some embodiments of the disclosure, the step 2 may include: step 21, magnitudes of the first dehydration rotational speed value and the preset rotational speed value are compared; step 22, if the first dehydration rotational speed value is smaller than the preset rotational speed value, a first dehydration operation is performed according to the first dehydration rotational speed value; and step 23, if the first dehydration rotational speed value is greater than or equal to the preset rotational speed value, a second dehydration operation is performed according to the preset rotational speed value.

In some embodiments of the disclosure, the step 3 may specifically include: after the first dehydration operation is performed, the current eccentricity value is detected to serve as the second eccentricity value.

In some embodiments of the disclosure, the step 4 may include: step 41, magnitudes of the second dehydration rotational speed value and the preset rotational speed value are compared; step 42, if the second dehydration rotational speed value is smaller than the preset rotational speed value, a third dehydration operation is performed according to the second dehydration rotational speed value, and the value of the second eccentricity value is assigned to the first eccentricity value; and step 43, if the second dehydration rotational speed value is greater than or equal to the preset rotational speed value, a fourth dehydration operation is performed according to the preset rotational speed value.

In some embodiments of the disclosure, after the step 42, the method may further include: step 42*a*, the second eccentricity value is assigned to the first eccentricity value, and then the step 3 is performed.

In some embodiments of the disclosure, the step 5 may include: after the number of times for performing the leveling operation exceeds a preset threshold value, the leveling operation is no longer performed.

The disclosure further provides a apparatus for washing machine dehydration, which may include: a first detection component, configured to detect a current eccentricity value to serve as a first eccentricity value, and determine a first dehydration rotational speed value corresponding to the first eccentricity value; a first dehydration component, configured to perform, according to a comparison result between the first dehydration rotational speed value and a preset rotational speed value, a corresponding dehydration operation; a second detection component, configured to detect, after the dehydration operation, another current eccentricity value to serve as a second eccentricity value, and determine a second dehydration rotational speed value corresponding to the second eccentricity value; a second dehydration component, configured to perform, under a condition in which the second eccentricity value is smaller than the first eccentricity value, according to a comparison result between the second dehydration rotational speed value and the preset rotational speed value, a corresponding dehydration operation, and assign the value of the second eccentricity value to the first eccentricity value; and a leveling component, configured to perform, under a condition in which the second eccentricity value is greater than or equal to the first eccentricity value, a leveling operation.

In some embodiments of the disclosure, the first dehydration component may include: a first comparison unit, configured to compare magnitudes of the first dehydration rotational speed value and the preset rotational speed value; and a first processing unit, configured to perform, under a condition in which the first dehydration rotational speed value is smaller than the preset rotational speed value, a first dehydration operation according to the first dehydration rotational speed value; and perform, under a condition in which the first dehydration rotational speed value is greater than or equal to the preset rotational speed value, a second dehydration operation according to the preset rotational speed value.

In some embodiments of the disclosure, the second detection component is specifically configured to detect, after the first dehydration operation is performed, the current eccentricity value to serve as the second eccentricity value.

In some embodiments of the disclosure, the second dehydration component may include: a second comparison unit, configured to compare magnitudes of the second dehydration rotational speed value and the preset rotational speed value; and a second processing unit, configured to perform, under a condition in which the second dehydration rotational speed value is smaller than the preset rotational speed value, a third dehydration operation according to the second dehydration rotational speed value, and assign the value of the second eccentricity value to the first eccentricity value; and perform, under a condition in which the second dehydration rotational speed value is greater than or equal to the preset rotational speed value, a fourth dehydration operation according to the preset rotational speed value.

In some embodiments of the disclosure, the leveling component is specifically configured to no longer perform, after the number of times for performing the leveling operation exceeds a preset threshold value, the leveling operation.

The disclosure further provides a washing machine, which may include the above-mentioned apparatus for washing machine dehydration.

DETAILED DESCRIPTION OF THE EMBODIMENTS

The disclosure will be further described below in detail in combination with accompanying drawings and specific embodiments, all of which do not form a limit to the disclosure.

Embodiment 1

Figure 1:
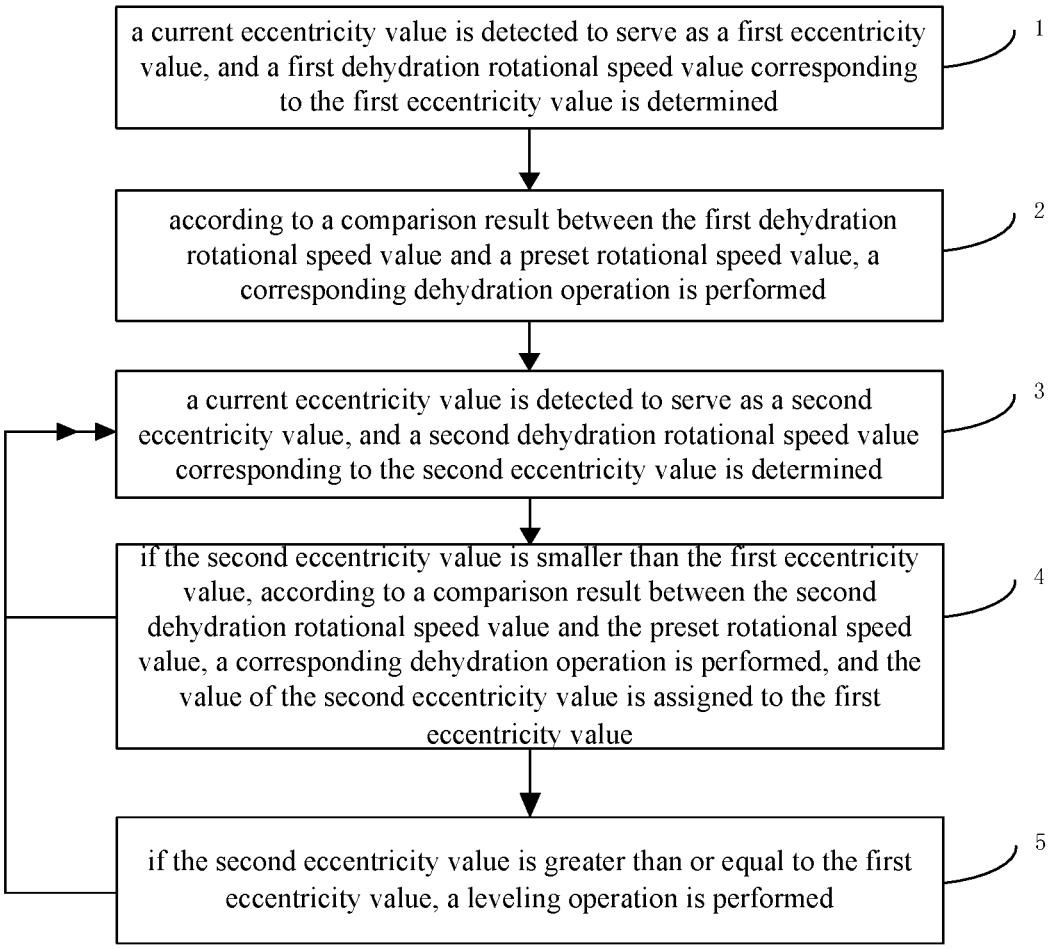
FIG. 1 is a flowchart of a method for washing machine dehydration according to an embodiment of the disclosure.

FIG. 1 is a flowchart of a method for washing machine dehydration according to an embodiment of the disclosure. As shown in FIG. 1, the method may include the following steps (step 1 to step 5).

At Step 1, a current eccentricity value is detected to serve as a first eccentricity value, and a first dehydration rotational speed value corresponding to the first eccentricity value is determined.

At Step 2, according to a comparison result between the first dehydration rotational speed value and a preset rotational speed value, a corresponding dehydration operation is performed.

At Step 3, a current eccentricity value is detected to serve as a second eccentricity value, and a second dehydration rotational speed value corresponding to the second eccentricity value is determined.

At Step 4, if the second eccentricity value is smaller than the first eccentricity value, according to a comparison result between the second dehydration rotational speed value and the preset rotational speed value, a corresponding dehydration operation is performed, the value of the second eccentricity value is assigned to the first eccentricity value and then the step 3 is performed.

At Step 5, if the second eccentricity value is greater than or equal to the first eccentricity value, a leveling operation is performed, and then the step 3 is performed.

Through this embodiment, the washing machine may enter dehydration and dehydrate to the fullest extent when a small load of clothes having good water absorbability are washed, thereby improving a dehydration effect of the washing machine and improving the user experience.

For specific implementation of the step 2, this embodiment provides a preferred implementation manner, i.e., the step 2 may include: step 21, magnitudes of the first dehydration rotational speed value and the preset rotational speed value are compared; step 22, if the first dehydration rotational speed value is smaller than the preset rotational speed value, a first dehydration operation is performed according to the first dehydration rotational speed value; and step 23, if the first dehydration rotational speed value is greater than or equal to the preset rotational speed value, a second dehydration operation is performed according to the preset rotational speed value, and the process is completed. In view of this, no matter how high an eccentricity value of clothes in the washing machine is, the dehydration operation may be started, and may be performed according to a corresponding rotational speed value.

In the step 3, specifically, after the first dehydration operation is performed, the current eccentricity value is detected to serve as the second eccentricity value, thereby providing a basis to further perform the dehydration operation.

For specific implementation of the step 2, this embodiment provides a preferred implementation manner, i.e., the step 4 may include: step 41, magnitudes of the second dehydration rotational speed value and the preset rotational speed value are compared; step 42, if the second dehydration rotational speed value is smaller than the preset rotational speed value, a third dehydration operation is performed according to the second dehydration rotational speed value, and the value of the second eccentricity value is assigned to the first eccentricity value; and step 43, if the second dehydration rotational speed value is greater than or equal to the preset rotational speed value, a fourth dehydration operation is performed according to the preset rotational speed value. Herein, after the step 42, the second eccentricity value is assigned to the first eccentricity value, and then the step 3 is performed. In view of this, when the previous dehydration operation does not achieve the best dehydration effect, the dehydration operation is performed again, and thus the eccentricity value is reduced gradually to improve the dehydration effect.

In the step 5, after the number of times for performing the leveling operation exceeds a preset threshold value, the leveling operation is no longer performed, and thus the washing machine is prevented from infinitely circulating the leveling operation.

Embodiment 2

Figure 2:
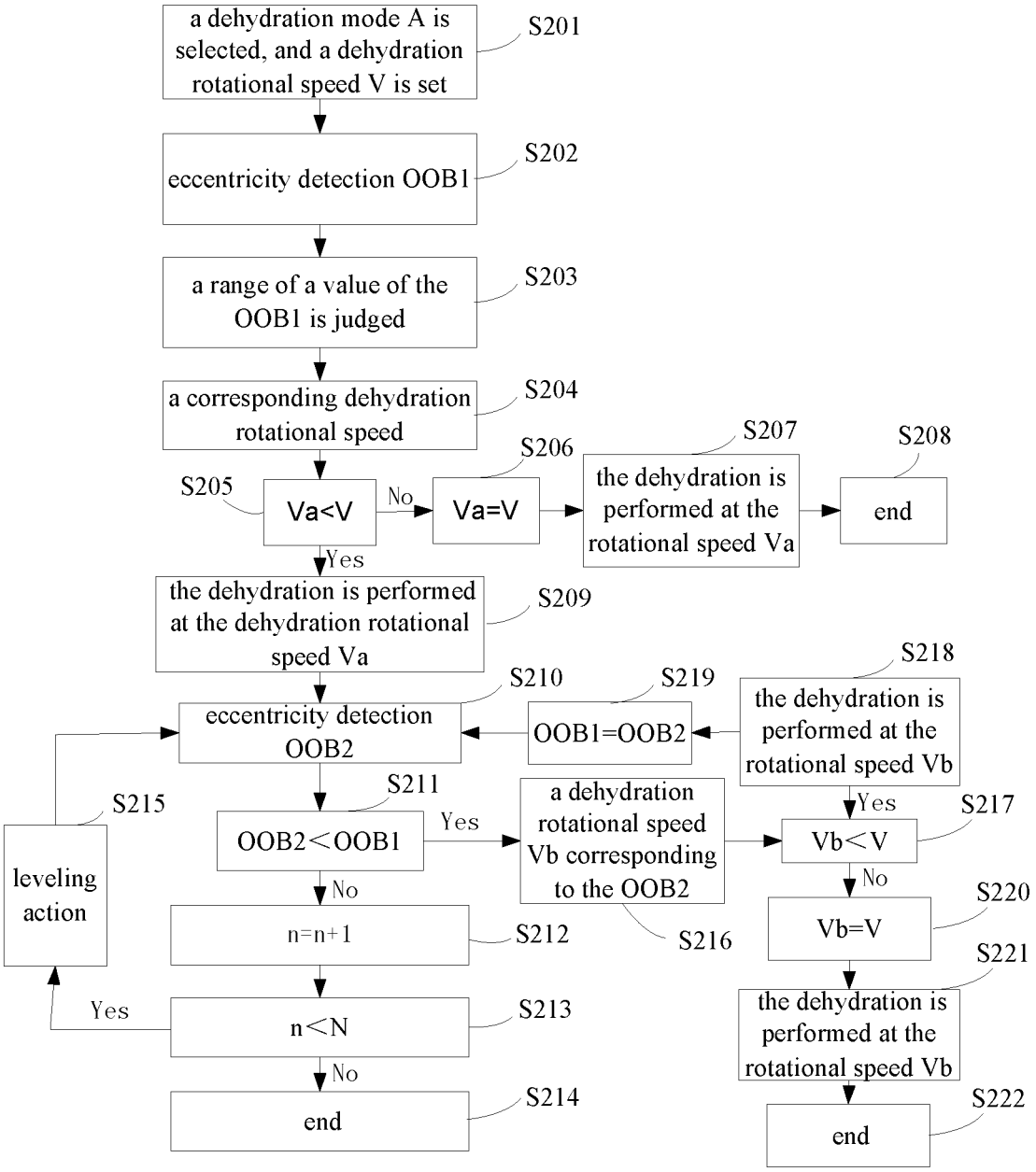
FIG. 2 is a dehydration flowchart of a washing machine according to an embodiment of the disclosure.

FIG. 2 is a dehydration flowchart of a washing machine according to an embodiment of the disclosure. As shown in FIG. 2, the method may include the following steps (step S201 to step S222).

At Step S201, a dehydration mode A is selected, and a dehydration rotational speed value V is preset.

At Step S202, initial eccentricity detection is performed, and a detected value is assigned as an initial eccentricity value OOB1.

At Step S203, a range Xi≤OOB1<Xi+1 of the initial eccentricity value OOB1 is determined.

At Step S204, a dehydration rotation value Va=Vi corresponding to the OOB1 is determined.

At Step S205, whether Va<V is satisfied or not is judged; if yes, the step S209 is performed; and if no, the step S206 is performed.

At Step S206, if Va≥V, the Va is assigned as the V, i.e., Va=V.

At Step S207, the dehydration is performed at the assigned rotational speed Va.

At Step S208, the dehydration process is ended.

At Step S209, if Va<V, the dehydration is performed at the Va rotational speed.

At Step S210, the eccentricity detection is performed again, where the detected value at this time is OOB2.

At Step S211, whether OOB2<OOB1 is satisfied or not is judged; if yes, the step S216 is performed; and if no, the step S212 is performed.

At Step S212, the number n of times for a leveling operation is added with 1.

At Step S213, whether n<N (a maximum number of times for levelling is preset, and N<10 may be set) is satisfied or not is judged; if yes, the step S215 is performed; and if no, the step S214 is performed.

At Step S214, the process is ended.

At Step S215, the leveling operation is performed.

At Step S216, a dehydration rotational speed value Vb corresponding to the OOB1 is determined.

At Step S217, whether Vb<V is satisfied or not is judged; if yes, the step S218 is performed; and if no, the step S220 is performed.

At Step S218, the dehydration is performed at the Vb rotational speed.

At Step S219, the value of the OOB2 is assigned to the OOB1, i.e., OOB1=OOB2.

At Step S220, the Vb is assigned as the V, i.e., Vb=V.

At Step S221, the dehydration is performed at the assigned rotational speed Vb.

At Step S222, the dehydration process is ended.

The existing washing machine enters a dehydration operation after the clothes are washed. The dehydration is divided into two times, namely, preliminary dehydration and final dehydration. Eccentricity detection is performed before the dehydration, and the magnitude of a dehydration speed is determined according to that of a detected eccentricity value. Table 1 illustrates a corresponding relationship table between an eccentricity value and a dehydration rotational speed. The smaller the eccentricity value, the greater the dehydration rotational speed; and the greater the eccentricity value, the smaller the dehydration rotational speed; therefore, it is assured that the dehydration operation is performed under the condition of small vibration.

TABLE 1

| | | | | | | |
|---|---|---|---|---|---|---|
| Eccentricity value OOB1/OOB2 | (0, X1) | (X1, X2) | — | (Xi, Xi + 1) | — | (Xn, Xn + 1) |
| Dehydration rotational speed value Va/Vb | V0 | V1 | — | Vi | — | Vn |

This embodiment proposes a cyclic eccentricity detection and dehydration method. A dehydration mode A is selected for a special load. A dehydration rotational speed V is set before dehydration. Initial eccentricity detection is performed to obtain an eccentricity value OOB1, and accordingly an initial dehydration speed Va is selected. When the Va is greater than or equal to the set dehydration rotational speed V, the Va is assigned as the V, then the dehydration is performed at the assigned rotational speed Va, and the dehydration is ended (such a situation is not occurred generally). When the Va is smaller than the set dehydration rotational speed V, the dehydration is performed at the rotational speed Va, and then the eccentricity detection is entered again. To detect the magnitude of the eccentricity value OOB2 again, there are the following two cases: when the subsequent eccentricity value OOB2 is smaller than the initial eccentricity value OOB1, the dehydration is performed at a higher rotational speed Vb, and at this moment, two cases are provided: Vb≥V, the Vb is assigned as the V, the dehydration is performed at the rotational speed Vb and the dehydration process is ended; and if Vb<V, the dehydration is performed at the rotational speed Vb, the OOB1 is assigned as the OOB2, the eccentricity detection is performed again, and the cycle is performed in this way till the dehydration rotational speed reaches to the set dehydration rotational speed. If the subsequent eccentricity value OOB2 is greater than the initial eccentricity value OOB1, the limited number N of times for a levelling operation is performed, an eccentricity value is detected after each time of levelling, and whether the dehydration operation or the levelling operation is entered is determined according to a comparison result between the eccentricity value and the initial eccentricity value, and the cycle is performed in this way till the number of times for levelling reaches to a preset number of times; at this moment, if the eccentricity value OOB2 is still greater than the initial eccentricity value, even though the previous dehydration rotational speed Vb is smaller than the set rotational speed V, the dehydration is still ended. Therefore, it is guaranteed that the small load of washed clothes having the good water absorbability can be dehydrated to the utmost extent and the dehydration can be performed at maximum.

Embodiment 3

Figure 3:
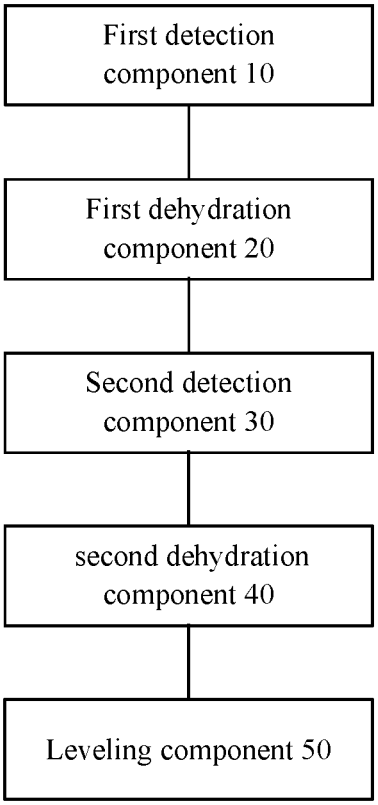
FIG. 3 is a structural block diagram of an apparatus for washing machine dehydration according to an embodiment of the disclosure.

Corresponding to the method for washing machine dehydration described in FIG. 1, this embodiment provides an apparatus for washing machine dehydration. FIG. 3 is a structural block diagram of an apparatus for washing machine dehydration. The apparatus may include a first detection component 10, a first dehydration component 20, a second detection component 30, a second dehydration component 40 and a levelling component 50.

The first detection component 10 is configured to detect a current eccentricity value to serve as a first eccentricity value, and determine a first dehydration rotational speed value corresponding to the first eccentricity value.

The first dehydration component 20 is connected to the first detection component 10, and is configured to perform, according to a comparison result between the first dehydration rotational speed value and a preset rotational speed value, a corresponding dehydration operation.

The second detection component 30 is connected to the first dehydration component 20, and is configured to detect, after the dehydration operation, another current eccentricity value to serve as a second eccentricity value, and determine a second dehydration rotational speed value corresponding to the second eccentricity value.

The second dehydration component 40 is connected to the second detection component 30, and is configured to perform, under a condition in which the second eccentricity value is smaller than the first eccentricity value, according to a comparison result between the second dehydration rotational speed value and the preset rotational speed value, a corresponding dehydration operation, and assign the value of the second eccentricity value to the first eccentricity value.

The leveling component 50 is connected to the second detection component 30, and is configured to perform, under a condition in which the second eccentricity value is greater than or equal to the first eccentricity value, a leveling operation.

Through this embodiment, the washing machine may enter dehydration and dehydrate to the fullest extent when a small load of clothes having good water absorbability are washed, thereby improving a dehydration effect of the washing machine and improving the user experience For specific implementation of the first dehydration component 20, this embodiment provides a preferred implementation manner, i.e., the first dehydration component 20 may include: a first comparison unit, configured to compare magnitudes of the first dehydration rotational speed value and the preset rotational speed value; and a first processing unit, configured to perform, under a condition in which the first dehydration rotational speed value is smaller than the preset rotational speed value, a first dehydration operation according to the first dehydration rotational speed value; and perform, under a condition in which the first dehydration rotational speed value is greater than or equal to the preset rotational speed value, a second dehydration operation according to the preset rotational speed value. In view of this, no matter how high an eccentricity value of clothes in the washing machine is, the dehydration operation may be started, and may be performed according to a corresponding rotational speed value.

It is to be noted that the second detection component 30 is specifically configured to detect, after the first dehydration operation is performed, the current eccentricity value to serve as the second eccentricity value. After the second dehydration operation is performed by the first processing unit, the dehydration process is ended.

For specific implementation of the second dehydration component 40, this embodiment provides a preferred implementation manner, i.e., the second dehydration component 40 may include: a second comparison unit, configured to compare magnitudes of the second dehydration rotational speed value and the preset rotational speed value; and a second processing unit, configured to perform, under a condition in which the second dehydration rotational speed value is smaller than the preset rotational speed value, a third dehydration operation according to the second dehydration rotational speed value, and assign the value of the second eccentricity value to the first eccentricity value; and perform, under a condition in which the second dehydration rotational speed value is greater than or equal to the preset rotational speed value, a fourth dehydration operation according to the preset rotational speed value. In view of this, when the previous dehydration operation does not achieve the best dehydration effect, the dehydration operation is performed again, and thus the eccentricity value is reduced gradually to improve the dehydration effect.

The leveling component 50 is specifically configured to no longer perform, after the number of times for performing the leveling operation exceeds a preset threshold value, the leveling operation, and thus the washing machine is prevented from infinitely circulating the leveling operation.

Figure 4:
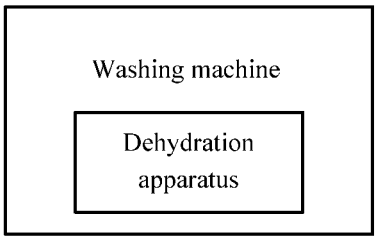
FIG. 4 is a structural block diagram of a washing machine according to an embodiment of the disclosure.

This embodiment further provides a washing machine. FIG. 4 is a structural block diagram of a washing machine. The washing machine includes the above-described apparatus for washing machine dehydration, thereby implementing smooth dehydration for a small load of clothes having water absorbability.

From the above description, the disclosure mainly implements the following several points: 1) when the small load of clothes having the good water absorbability are dehydrated, the dehydration is circulated for multiple times, the dehydration rotational speed is gradually increased and thus the clothes can be dehydrated completely; 2) because the eccentricity value detected before the dehydration is very high, in order to control the vibration, the washing machine enters low-speed dehydration; and 3) while the eccentricity value is reduced after the dehydration, the vibration at a higher dehydration rotational speed is controlled; by further increasing the dehydration rotational speed to be a rotational speed that is as high as possible or the set rotational speed, the clothes are dehydrated as much as possible.

Certainly, the above are preferred implementation manners of the disclosure. It is to be noted that about those of ordinary skill in the art, under the precondition without departing from the basic principle of the disclosure, a plurality of improvements and modifications may be performed, and the improvements and modifications are also included within the scope of protection of the disclosure.

What is claimed:

1. A method for washing machine dehydration, comprising:

step 1, detecting a current eccentricity value to serve as a first eccentricity value, and determining and selecting a first dehydration rotational speed value corresponding to the first eccentricity value;

step 2, performing a corresponding dehydration operation, according to a comparison result between the first dehydration rotational speed value and a preset rotational speed value, wherein the preset rotational speed value is a set dehydration rotational speed;

step 3, detecting another current eccentricity value to serve as a second eccentricity value, and determining and selecting a second dehydration rotational speed value corresponding to the second eccentricity value;

step 4, after the step 3, if the second eccentricity value is smaller than the first eccentricity value, according to a comparison result between the second dehydration rotational speed value and the preset rotational speed value, performing a corresponding dehydration operation; if the second dehydration rotational speed value is smaller than the preset rotational speed value, assigning the value of the second eccentricity value to the first eccentricity value and then returning to the step 3; and step 5, after the step 3, if the second eccentricity value is greater than or equal to the first eccentricity value, performing a leveling operation, and then returning to the step 3.

2. The method as claimed in claim 1, wherein the step 2 comprises:

step 21, comparing magnitudes of the first dehydration rotational speed value and the preset rotational speed value;

step 22, if the first dehydration rotational speed value is smaller than the preset rotational speed value, performing a first dehydration operation according to the first dehydration rotational speed value; and step 23, if the first dehydration rotational speed value is greater than or equal to the preset rotational speed value, performing a second dehydration operation according to the preset rotational speed value.

3. The method as claimed in claim 2, wherein the step 3 specifically comprises: after the first dehydration operation is performed, detecting the current eccentricity value to serve as the second eccentricity value.

4. The method as claimed in claim 1, wherein the step 4 comprises:

step 41, comparing magnitudes of the second dehydration rotational speed value and the preset rotational speed value;

step 42, if the second dehydration rotational speed value is smaller than the preset rotational speed value, performing a third dehydration operation according to the second dehydration rotational speed value, and assigning the value of the second eccentricity value to the first eccentricity value; and step 43, if the second dehydration rotational speed value is greater than or equal to the preset rotational speed value, performing a fourth dehydration operation according to the preset rotational speed value.

5. The method as claimed in claim 4, wherein after the step 42, the method further comprises:

step 42*a*, assigning the second eccentricity value to the first eccentricity value, and then performing the step 3.

6. The method as claimed in claim 1, wherein the step 5 comprises:

after the number of times for performing the leveling operation exceeds a preset threshold value, no longer performing the leveling operation.

7. An apparatus for washing machine dehydration, comprising:

a first detection component, configured to detect a current eccentricity value to serve as a first eccentricity value, and determine and select a first dehydration rotational speed value corresponding to the first eccentricity value;

a first dehydration component, configured to perform, according to a comparison result between the first dehydration rotational speed value and a preset rotational speed value, a corresponding dehydration operation, wherein the preset rotational speed value is a set dehydration rotational speed;

a second detection component, configured to detect, after the dehydration operation, another current eccentricity value to serve as a second eccentricity value, and determine and select a second dehydration rotational speed value corresponding to the second eccentricity value;

a second dehydration component, configured to perform, under a condition in which the second eccentricity value is smaller than the first eccentricity value, according to a comparison result between the second dehydration rotational speed value and the preset rotational speed value, a corresponding dehydration operation, and assign the value of the second eccentricity value to the first eccentricity value in a case that the second dehydration rotational speed value is smaller than the preset rotational speed value; and a leveling component, configured to perform, under a condition in which the second eccentricity value is greater than or equal to the first eccentricity value, a leveling operation.

8. The apparatus as claimed in claim 7, wherein the first dehydration component comprises:

a first comparison unit, configured to compare magnitudes of the first dehydration rotational speed value and the preset rotational speed value; and a first processing unit, configured to perform, under a condition in which the first dehydration rotational speed value is smaller than the preset rotational speed value, a first dehydration operation according to the first dehydration rotational speed value; and perform, under a condition in which the first dehydration rotational speed value is greater than or equal to the preset rotational speed value, a second dehydration operation according to the preset rotational speed value.

9. The apparatus as claimed in claim 8, wherein the second detection component is specifically configured to detect, after the first dehydration operation is performed, the current eccentricity value to serve as the second eccentricity value.

10. The apparatus as claimed in claim 7, wherein the second dehydration component comprises:

a second comparison unit, configured to compare magnitudes of the second dehydration rotational speed value and the preset rotational speed value; and a second processing unit, configured to perform, under a condition in which the second dehydration rotational speed value is smaller than the preset rotational speed value, a third dehydration operation according to the second dehydration rotational speed value, and assign the value of the second eccentricity value to the first eccentricity value; and perform, under a condition in which the second dehydration rotational speed value is greater than or equal to the preset rotational speed value, a fourth dehydration operation according to the preset rotational speed value.

11. The apparatus as claimed in claim 7, wherein the leveling component is specifically configured to no longer perform, after the number of times for performing the leveling operation exceeds a preset threshold value, the leveling operation.

12. A washing machine, comprising the apparatus for washing machine dehydration as claimed in claim 7.

* * * * *